US005884637A

United States Patent [19]

Joulia

[11] Patent Number: 5,884,637

[45] Date of Patent: Mar. 23, 1999

[54] CASE FOR THE PACKAGING OF A SOLID OR SEMI-SOLID PRODUCT

[75] Inventor: Gerard Joulia, Paris, France

[73] Assignee: L'Oreal, Paris, France

[21] Appl. No.: 920,720

[22] Filed: Aug. 29, 1997

[30] Foreign Application Priority Data

Sep. 2, 1996 [FR] France ..... 96-10690

[51] Int. Cl.[6] ..... A45D 40/12

[52] U.S. Cl. ..... 132/318; 401/98

[58] Field of Search ..... 132/317, 318, 132/293; 401/49, 50, 88, 98, DIG. 1

[56] References Cited

U.S. PATENT DOCUMENTS

| | | | |
|---|---|---|---|
| 3,397,027 | 8/1968 | Harrison | 401/50 |
| 4,728,210 | 3/1988 | Barish et al. | 401/88 |
| 5,046,875 | 9/1991 | Skolnik | 401/49 |
| 5,092,700 | 3/1992 | Susini et al. | 401/49 |
| 5,167,462 | 12/1992 | Lucas | 401/98 |
| 5,738,123 | 4/1998 | Szekely | 401/98 |

FOREIGN PATENT DOCUMENTS

| | | |
|---|---|---|
| 444992 | 9/1991 | European Pat. Off. . |
| 644126 | 3/1995 | European Pat. Off. . |
| 2510073 | 1/1983 | France . |

*Primary Examiner*—Todd E. Manahan

*Attorney, Agent, or Firm*—Oblon, Spivak, McClelland, Maier & Neustadt, P.C.

[57] ABSTRACT

A case for the packaging of a product in the form of a solid or semi-solid block includes: a bottom portion defining a receptacle for the solid block, structure or element penetrating into the solid block so as to immobilize the solid block inside the receptacle, a cap removably placed on one surface of the product so as to retain the block in the receptacle, and a lid removably fitted onto the bottom portion so as selectively to open/close the case. This case furthermore includes structure for coupling the lid and the cap so that opening the case by rotating the lid with respect to the bottom portion causes the cap to rotate through a given angle with respect to the product, thus inducing a shearing effect between the internal surface of the cap and the surface of the product.

19 Claims, 3 Drawing Sheets

CASE FOR THE PACKAGING OF A SOLID OR SEMI-SOLID PRODUCT

BACKGROUND OF THE INVENTION

1. Field of the Invention

The present invention relates to a case for the packaging and presentation of a product in the form of a solid block which is able to be crumbled into powder. Generally, this product is a make-up product, also called a "cake". This product may be placed in the case by pouring the product in liquefied form, which solidifies to transform into a solid product able to be crumbled into powder and to be taken up by the user, using her finger, a powderpuff or a brush. More particularly, the product targeted by the invention is a blusher, an eyeshadow or a foundation.

The liquefied make-up product may be in the form of a paste, obtained by mixing a particulate solid phase with either an aqueous phase or a binder, in particular a fatty phase in a solvent; it may also be in the form of a product, based on heat-meltable waxes or on a gel, which is poured when hot. Depending on the type of composition chosen, solidification therefore occurs either by evaporation of water or solvent, or by cooling, or by a chemical reaction.

2. Discussion of the Background

A liquefied make-up product cast in volume in a mold is known, this mold having a molding surface, which gives the product's shape (which is flat, domed or provided with raised or recessed patterns) at the surface from which the product will be taken up, and a bottom portion provided with one or more filling holes through which the product is poured.

Thus, EP-A-0,628,393 in the name of the Applicant discloses a case for the manufacture and presentation of a solid product able to be crumbled into a powder, this case being used as a mold for casting the liquefied product. According to that document, the case consists of a bottom portion provided with a circular edge and of a domed lid which is screwed onto the edge of the bottom portion. This bottom portion is provided with a filling hole. The internal side of the bottom portion is provided with a flat ring made of cellular foam. In order to fill it this case is turned upside down so that it rests on its lid. The liquefied product may then be poured through the filling hole and the center of the flat ring into the volume defined between the lid and the bottom portion. The liquefied product partly penetrates the flat foam ring, where it remains attached after solidification.

The Applicant has found that it is preferable, in particular for sealing reasons and with a concern to guarantee a perfectly smooth surface finish, to insert a thermoformed cap between the lid and the product so that this cap constitutes the base of the mold when casting the product. Furthermore, such a cap can be used as an indicator that the product has not been tampered with, this being particularly advantageous when the case is displayed on the shelves of a supermarket.

Experiments carried out by the Applicant have demonstrated that when, for the purpose of applying a make-up, the user removes such a cap, simply by pulling it, some of the product remained attached to the cap, making the surface from which product was taken up unattractive and friable.

SUMMARY OF THE INVENTION

The Applicant has sought to remedy this drawback. Unexpectedly, the Applicant has found that, by lifting off the cap after having rotated it, the solid product kept a smooth and non-friable surface from which the product will be taken up. In order to avoid the user having to lift up the cap vertically, the Applicant has sought to produce a mechanism which enables the cap to be slightly rotated automatically when opening the case. Separation of the product from the cap must, as it were, be effected by shearing.

This objective is achieved by temporarily coupling the cap to the lid so that the cover, as it is unscrewed, forces the cap to rotate, for example through a quarter-turn or a half-turn.

Thus, the present invention provides a case for the packaging of a product in the form of a solid or semi-solid block, comprising: a bottom portion defining a receptacle for the solid block, an element attached to the receptacle to immobilize the block inside the receptacle, a cap removably placed on one surface of the product so as to retain the block in the receptacle, and a lid removably fitted onto the bottom portion so as selectively to open/close the case. According to the invention, this case furthermore comprises structure for coupling the lid and the cap so that opening the case by rotating the lid with respect to the bottom portion causes the cap to rotate through a given angle with respect to the product, thus inducing a shearing effect between the internal surface of the cap and the surface of the product.

The expression "product in the form of a solid or semi-solid block" means any product, able to be crumbled into powder, the consistency of which does not enable it to flow away under the effect of its own weight.

Advantageously, the bottom portion is provided with a cylindrical edge and with an external thread, a hole being provided for filling with product, this hole passing through the bottom portion and the said means of attachment, and the cap bearing against the cylindrical edge. Advantageously the lid is able to fit, for example by screwing, onto the edge of the bottom portion. According to a beneficial aspect of the invention the structure for coupling includes, at one or more drive members carried by the cap and engaging with one or more complementary members carried by the internal surface of the lid, a rotational movement of the lid with respect to the bottom portion when opening the case, causing the drive member and the complementary member to be brought into engagement thereby forcing the cap to rotate with respect to the product.

In particular, the structure for coupling may include one or more notches arranged around a peripheral edge of the cap and intended to engage with one or more cogs arranged around the internal periphery of the lid, the rotation of the lid with respect to the bottom portion causing one of the notches to be brought into engagement with one of the cogs.

However it is possible to arrange the drive members at any point on the cap, on condition that this point lies opposite the lid. In this case the lid carries complementary members which engage with the drive members on the cap.

When several notches and several cogs are provided these are advantageously distributed uniformly around the cap and the lid respectively. The number of notches may be equal to the number of cogs. However, it is advantageous to provide a number of notches which differs from the number of cogs by at least one. By means of this arrangement the angle by which a cog engages in a notch may be considerably reduced.

In a particular embodiment, the peripheral edge of the cap has n notches which are distributed uniformly around the peripheral edge of the cap and are arranged opposite n−1 cogs which are distributed uniformly around the internal surface of the lid, n being at least equal to 2. In general, engagement of a cog in a notch is all the more rapidly achieved the greater is the number of notches and cogs on the cap and lid respectively.

Advantageously, the number n is equal to or greater than 6. More particularly, for example with a number n of notches equal to 13 and a number of cogs n−1 equal to 12, engagement of a cog in a notch is achieved after a maximum angle of rotation of the lid, with respect to the bottom portion, which is equal to or less than 2° 4'.

Advantageously, the element attached to the receptacle consists of an annular sheet made of open-cell foam. Preferably, an elastically deformable sheet of foam is used. This sheet of foam serves as a support for the product, which is particularly advantageous when the product shrinks significantly on solidifying. This is because, when casting the product, the product partly penetrates into the cells where it solidifies without embrittling the cast cake, as indicated in the aforementioned document EP-A-0,628,393. The sheet of foam may be fastened to the bottom portion either by wedging or by adhesive bonding or by heat welding.

It is quite clear that the means of attachment may consist of any anchoring means, for example tabs carried by the support plate which penetrate into the solidified product, this being possible for any product exhibiting no or little shrinkage when it solidifies.

In a preferred embodiment, the cylindrical edge of the bottom portion has a free end on which the cap is laid. This cap has an axis of revolution coincident with the axis of the case.

Advantageously, this cap has a peripheral skirt sealing against the free end of the cylindrical edge of the bottom portion. The cap may have a convexo-concave shape, for example a dome shape, the convexity of the cap being turned towards the outside of the case. Any other shape having an axis of rotation may also be suitable. By means of this arrangement the cap, the sheet of foam, and the support plate, define a volume intended to accommodate the product. Thus, these components form a "mold" into which the product may be deposited by pouring.

In this configuration the product must be liquefiable, able to be put into the "mold" by pouring it through the filing hole and through the open center of the flat ring of foam, and able to solidify in the volume after being cast. In order to pour the liquefied product, the case is turned upside down so that the filling hole becomes accessible. The "mold" is then completely filled, taking care to immerse the flat ring of foam in the product. After the product has solidified, the filling hole in the support plate may be closed off by a plug.

In a preferred embodiment of the invention the product to be cast contains, in addition to colored pigments, fillers and binders, calcium sulphate hemihydrate ($CaSO_4.½H_2O$) and a sufficient quantity of water to obtain a castable mixture, solidification occurring, after casting in the case, by the formation of calcium sulphate dihydrate ($CaSO_4.½H_2O$). Where necessary, the castable mixture may contain an agent which modifies the calcium sulphate hemihydrate setting time.

However, it is possible to use products which liquefy at high temperature and solidify after cooling. It is also conceivable to cast a dispersion of pigments in a solvent, the product solidifying by evaporation of the solvent.

According to a beneficial aspect of the invention, the lid and the cap are transparent. This arrangement has the advantage that the product is visible from the outside, the case thus having a showcase function. For this purpose, the lid may be molded in a transparent material such as polystyrene. As regards the cap, this may be obtained by thermoforming a transparent sheet, made of a material such as PVC (polyvinyl chloride), polypropylene, polycarbonate, polystyrene, polyethylene terephthalate, etc.

In order to fix the cap onto the cylindrical edge of the bottom portion, the lid is advantageously provided with an internal projection which is able to be applied against the face opposite that part of the cap which is in contact with the free end of the cylindrical edge of the bottom portion. In turn, the lid, provided with an internal thread, can be reversibly fitted, by screwing, onto the external thread of the bottom portion. Thus, the cap is sandwiched between the lid and the bottom portion.

For applying make-up, it is sufficient to unscrew the lid. In accordance with the invention, unscrewing the lid forces the cap to rotate through the angle of rotation described above. When unscrewing the lid, a cog very soon engages in a notch and forces the cap to rotate. At the same time, the lid moves upwards along the axis of the case, causing, after having moved through an angle lying, for example, between approximately 10° and approximately 180°, disengagement of the notch and cog in question. Preferably, this angle lies between 90° and 180°. The value of the angle may be adjusted depending on the pitch of the thread produced on the lid and the bottom portion respectively, as well as on the height of the cog. Thereafter, it is sufficient to unscrew the lid completely and to remove the cap simply by pulling it.

As the cap may thus be separated from the product by a relative shearing movement, the application surface is smooth and bears no traces of crumbling.

Advantageously, the product packaged in the case is a blusher, an eyeshadow or a foundation.

BRIEF DESCRIPTION OF THE DRAWINGS

In order to make the present invention more clearly understood, a description will now be given, by way of purely illustrative and entirely non-limiting example, of an embodiment of a case according to the invention, with reference to the appended drawings, wherein.

DESCRIPTION OF THE PREFERRED EMBODIMENTS

Figure 1:
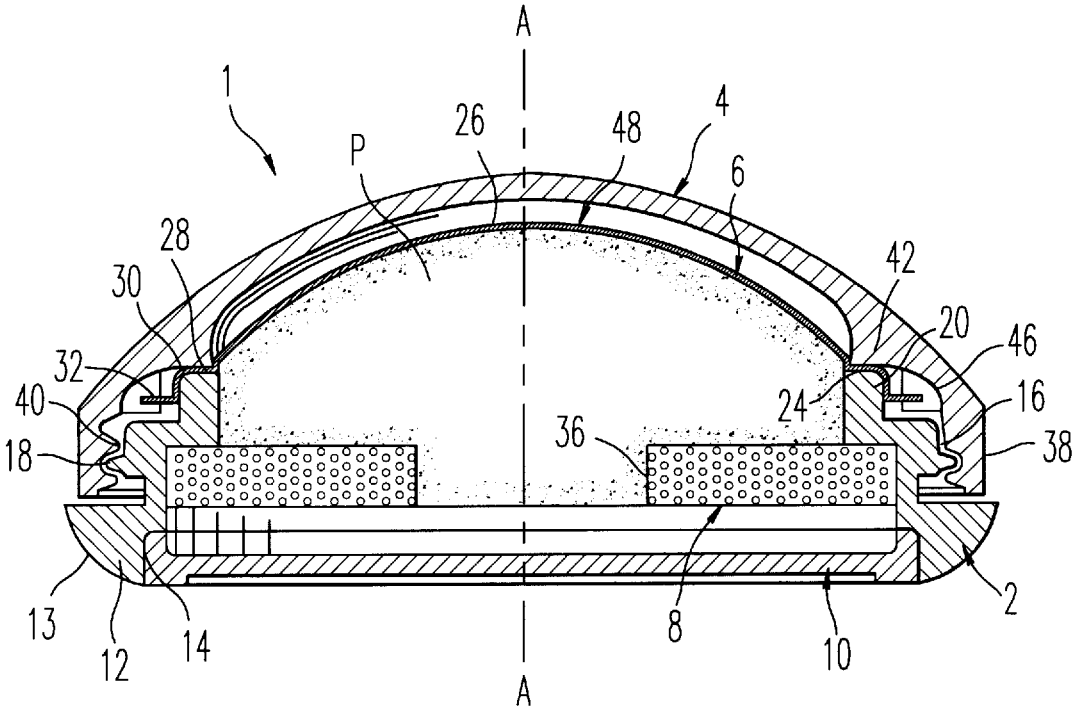
FIG. 1 shows an axial cross-section of the case of the invention, provided with a cap.

Referring to these Figures, in particular to FIG. 1, it may be seen that the entirety of a make-up case has been denoted by the label 1. The case contains a solid blusher P which is able to be crumbled into powder. This case has an axis of rotation A and is composed of a bottom portion 2 which defines a receptacle and is surmounted by a transparent lid 4 and a transparent cap 6, a flat ring of cellular foam 8, and a plug 10.

The bottom portion 2 has an annular structure and includes a base 12 provided with a wide central opening 14 into which the plug 10 is inserted.

On the bottom side the base 12 has a periphery 13 of rounded shape, approximately in the form of a quadrant of a circle. On the side remote from the base 12, the bottom portion has a short cylindrical portion 16 of smaller diameter than the base 12, this portion 16 being provided with an external thread 18 serving to affix the lid 4. Joined to the portion 16 is a cylindrical skirt 20 whose diameter is less than that of the portion 16, forming an internal step 22. The skirt 20 has a free end forming a cylindrical edge 24 in contact with the cap 6.

This cap 6 is produced by thermoforming, in particular using a sheet of transparent PVC. It is also possible to produce it from polypropylene, polycarbonate, polystyrene, polyethylene terephthalate, etc.

Figure 2:
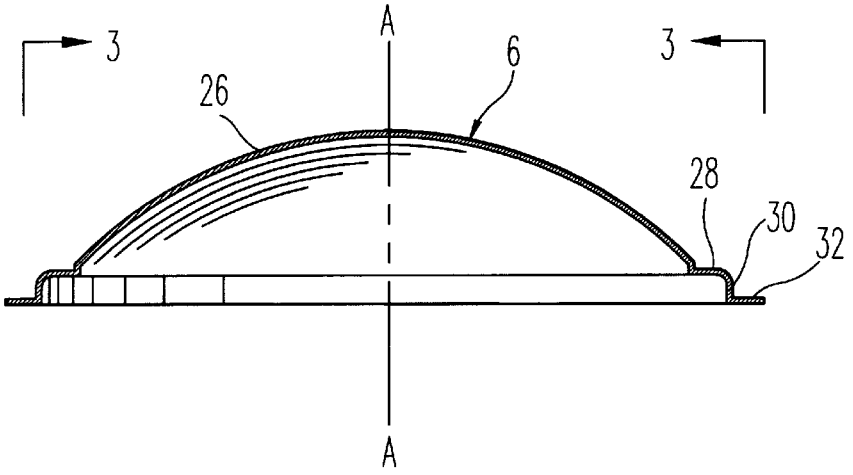
FIG. 2 shows an axial cross-section of the cap of the case in FIG. 1.
Figure 3:
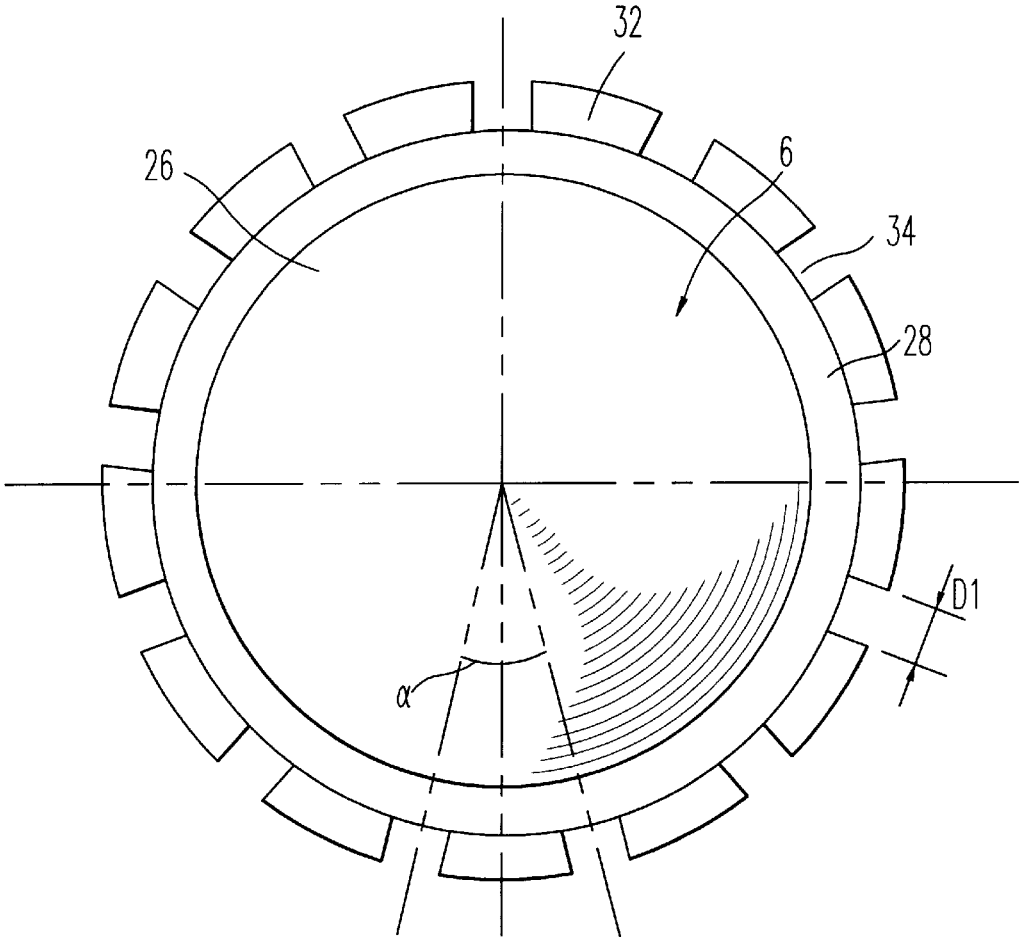
FIG. 3 shows a plan view of the cap of the case in FIG. 1, in the direction III—III in FIG. 2.

As may be seen in FIGS. 2 and 3, the cap 6 includes a convex dome-shaped central part 26 joined to an annular flat piece 28 the width of which corresponds substantially to the width of the edge 24. The flat piece 28 is bent at right-angles in order to form a short cylindrical part 30 which is itself bent radially outwardly in order to form an annular rim 32. The cylindrical part 30 bears frictionally against the external wall of the skirt 20. The rim 32 has a number n of notches or crenels 34, uniformly spaced apart around its periphery. Typically, n is equal to or greater than 2, preferably greater than or equal to 6. In the embodiment illustrated, the rim 32 is interrupted by 13 crenels 34 which are uniformly distributed around this rim (see FIG. 3). Each crenel 34 is separated from an adjacent crenel by an angle $\alpha$ of 27.7°. The width of each crenel 34 is shown symbolically by the label $d_1$ (see FIG. 3).

In another embodiment, not shown, the coupling means have a number of raised features arranged on the external surface of the cap, these being intended to engage with complementary recessed features made in the internal surface of the lid. Such raised features may be located, for example, around the center of the cap, or elsewhere, between the axis and the periphery.

Placed inside the receptacle 2 is the flat ring 8, which has a central opening 36. In this embodiment the opening 14 in the bottom portion and the opening 36 in the flat ring 8 constitute a hole for filling with the product P. The flat ring 8 extends radially as far as the cylindrical portion 16 and is held in place under the step 22 where it is fixed by heat welding. The flat ring 8 is made of an elastically compressible open-cell foam, for example a polyethylene foam. It constitutes the means of attachment of the block of product P. It may be fastened to the bottom portion 2 by adhesive bonding, or also by any other suitable means.

Figure 4:
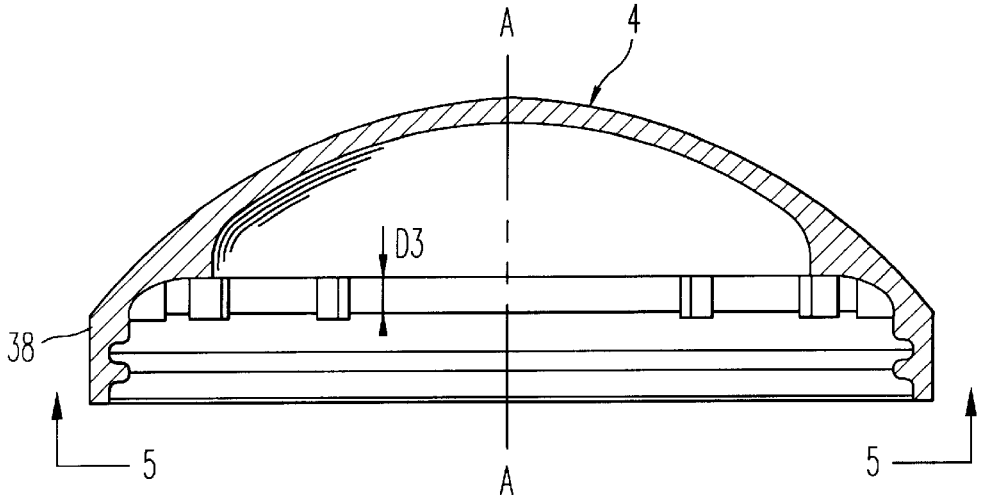
FIG. 4 shows an axial cross-section of the lid of the case in FIG. 1.
Figure 5:
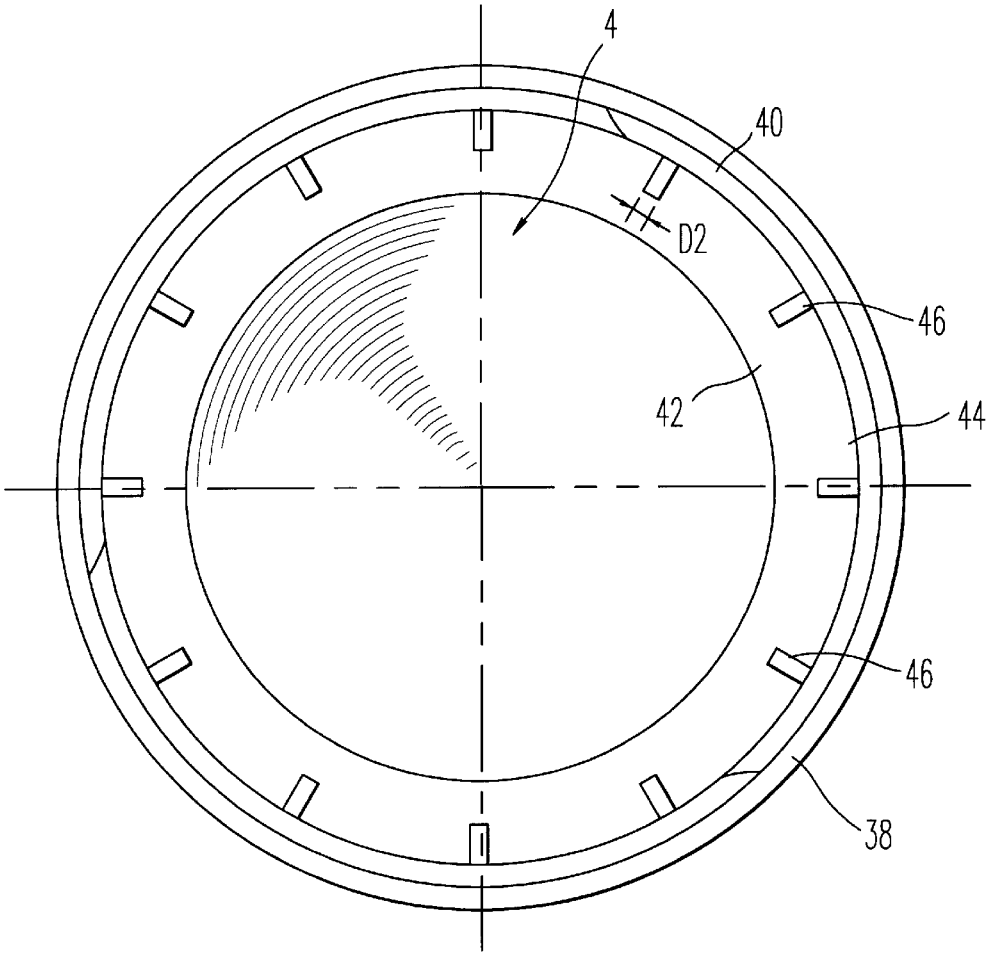
FIG. 5 shows a plan view of the lid of the case in FIG. 1, in the direction V—V in FIG. 4.

The lid 4 (see in particular FIGS. 4 and 5) is dome-shaped and has a size sufficient for it to be laid on top of the cap 6. It is molded in a material which is preferably transparent. Polystyrene may be used, for example. It has a cylindrical side wall 38 provided on the inside with a thread which is able to engage with the thread 18 on the bottom portion 2. The lid 4 has, in addition, an annular internal projection 42 which is able to bear against the annular flat piece 28 of the cap 6 so as to immobilize the cap when the lid is fixed onto the bottom portion 2. Cogs 46, intended to engage in the notches 34 of the cap 6, are uniformly distributed around an internal perimeter 44 of the wall of the lid 4, this perimeter lying between the projection 42 and the thread 40. Typically, for a number n of notches 34 ($n \geqq 2$) in the cap 6, a certain number of cogs 46 are provided on the lid 4. Advantageously, the number of cogs 46 differs from the number of notches 34 by at least one. In the embodiment illustrated in FIG. 5, 12 cogs 46 are provided. Each cog 46 has a width $d_2$ less than the width $d_1$ of the crenels 34. The cogs 46 have a height $d_3$ (see FIG. 4) sufficient for them to bear, in the closed position of the case, on the rim 32 of the cap 6. The notches 34 can be called drive members and the cogs 46 can be called complementary members.

The flat ring 8, the skirt 20 and the cap 6 define a predetermined volume which is able to receive, for example by pouring, an appropriate quantity of product P in the liquefied state. In order to pour in this way, the bottom portion 2 provided with the flat foam ring 8 is assembled with the cap 6. The cylindrical part of the cap 6 is friction-fitted onto the skirt 20 of the bottom portion 2. This assembly is laid, cap down, so that the filling hole 14, 36 is accessible. A quantity of product P in the liquid state, sufficient to immerse the flat ring 8 in the product, is then poured. After the product has solidified, the opening 14 in the bottom portion 2 is closed by the plug 10 and the lid 4 is affixed, by screwing onto the thread 18 on the bottom portion. Because of the transparency of the cap 6 and of the lid 4 the user is able, at a single glance, to check the colour of the product P.

In order to apply make-up, the user removes the lid 4 by unscrewing. During rotation of the lid with respect to the bottom portion, one of the cogs 46 very soon, i.e. after rotating through an angle of less than 2° 4' in the case of the configuration detailed above, engages one of the crenels 34. When the user continues unscrewing, the lid 4 forces the cap 6 to rotate. As the cap 6 rotates, it detaches itself from the solid product P by shearing. At the same time, the lid 4 moves axially away from the bottom portion 2 so that, after unscrewing a quarter-turn or half-turn, the cog 46 disengages from the crenel 34. At this stage, the cap 6 is still fastened to the bottom portion 2. After completely unscrewing the lid 4 the user can remove the cap 6, simply by pulling on it, without causing deterioration of the surface 48 (FIG. 1) from which the product P is taken up.

The use of a cap 6 for molding the surface 48 from which product is taken up of the case has several advantages. When pouring the liquefied product, the presence of the cap 6 prevents the threads 18 and 40 from becoming blocked up, since the volume for the product is sealed at the edge 24 of the bottom portion 2 and the cylindrical part 30 of the cap 6. Furthermore, without having to change the shape of the bottom portion 2, of the flat ring 8 or of the lid 4, it is possible to modify the shape of the surface 48 from which product is taken up. Thus, the surface 48 may have a flat shape, a conical shape, a shape with concentric annular beads, etc. In fact, it is possible to produce any shape of cap, as long as this shape has an axis of rotation A. From the economic standpoint, it is advantageous to produce such a cap 6 by thermoforming.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A case for the packaging of a product in the form of a solid or semi-solid block, the case in combination with the product comprising:

a bottom portion defining a receptacle for the product;

an element attached to the receptacle, the element penetrating into the product so as to immobilize the solid block inside the receptacle;

a cap removably mounted on one surface of the product so as to retain the solid block in the receptacle; and a lid removably fitted onto the bottom portion so as to open or close the case;

wherein the lid and the cap are rotatably coupled so that a shearing effect is induced between an internal surface of the cap and the surface of the product when the lid and cap are rotated.

2. A case according to claim 1, wherein the bottom portion includes a cylindrical portion having an external thread, the bottom portion having a hole, said hole passing through both the bottom portion and said element, and the bottom portion having a cylindrical edge that bears against the cap, the lid being threadedly engaged onto the cylindrical portion of the bottom portion, the cap includes at least one drive member, and the lid includes at least one complementary member, wherein a rotational movement of the lid with respect to the bottom portion when opening the case causes the at least one drive member and the at least one complementary member to be brought into engagement thereby forcing the cap to rotate through an angle.

3. A case according to claim 2, wherein the at least one drive member includes at least one notch located on a peripheral edge of the cap and the at least one complementary member includes at least one cog located on an internal surface of the lid, the at least one notch engageable with the at least one cog, wherein rotation of the lid with respect to the bottom portion causes the at least one notch to be brought into engagement with the at least one cog.

4. A case according to claim 3, wherein the at least one notch includes a plurality of notches, the number of notches differing from the number of cogs by at least one.

5. A case according to claim 4, wherein the notches are distributed uniformly around the peripheral edge of the cap, the number of notches being at least two, the number of notches being greater than the number of cogs, and the cogs are distributed uniformly around the internal surface of the lid.

6. A case according to claim 5, wherein the number of notches is at least six.

7. A case according to claim 5, wherein the number of notches is thirteen.

8. A case according to claim 2, wherein the product is liquefiable so that the product is placed into the receptacle of the case by pouring it through the hole, the liquefiable product solidifying in the receptacle after pouring.

9. A case according to claim 2, further comprising a plug, the plug fitted into the hole so as to close off the hole.

10. A case according to claim 1, wherein an angle of rotation of the cap relative to the product is between 10° and 180°.

11. A case according to claim 1, wherein an angle of rotation of the cap relative to the product is between 90° and 180°.

12. A case according to one claim 1, wherein the element comprises an annular sheet of open-cell foam.

13. A case according to claim 1, wherein the lid is transparent.

14. A case according to claim 1, wherein the cap is transparent.

15. A case according to claim 1, wherein the cap has the shape of a dome.

16. A case according to claim 1, wherein the cap is made of a material selected from the group consisting of polyvinyl chloride, polypropylene, polycarbonate, polystyrene and polyethylene terephthalate.

17. A case according to claim 1, wherein the product is a blusher or an eyeshadow.

18. A case according to claim 1, wherein the product contains hydrated gypsum.

19. A case according to claim 1, wherein the product contains pigments.

* * * * *

UNITED STATES PATENT AND TRADEMARK OFFICE

CERTIFICATE OF CORRECTION

PATENT NO. : 5,884,637
DATED : March 23, 1999
INVENTOR(S) : Gerard Joulia

It is certified that error appears in the above-identified patent and that said Letters Patent is hereby corrected as shown below:

Column 6,
Lines 62-63, change "solid block" to -- product --;
Line 65, change "solid block" to -- product --.

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*